United States Patent [19]

Weinstein

[11] Patent Number: 4,943,005

[45] Date of Patent: Jul. 24, 1990

[54] ROTARY ATOMIZING DEVICE

[75] Inventor: Richard Weinstein, Toledo, Ohio

[73] Assignee: Illinois Tool Works, Inc., Chicago, Ill.

[21] Appl. No.: 385,734

[22] Filed: Jul. 26, 1989

[51] Int. Cl.[5] ..... B05B 3/10

[52] U.S. Cl. ..... 239/223; 239/703

[58] Field of Search ..... 239/223, 224, 700, 701, 239/702, 703

[56] References Cited

U.S. PATENT DOCUMENTS

| | | | |
|---|---|---|---|
| 3,121,024 | 2/1964 | Wampler et al. | 239/223 |
| 3,233,580 | 2/1966 | Levake | 239/223 |
| 3,552,652 | 1/1971 | Greenwood | 239/77 |
| 4,405,086 | 9/1983 | Vetter | 239/224 |
| 4,505,430 | 3/1985 | Rodgers et al. | 239/112 |
| 4,643,357 | 2/1987 | Culbertson et al. | 239/110 |
| 4,776,520 | 10/1988 | Merritt | 239/700 |
| 4,795,095 | 1/1989 | Shepard | 239/224 |

FOREIGN PATENT DOCUMENTS 922212 6/1947 France .

*Primary Examiner*—Andres Kashnikow
*Assistant Examiner*—Michael J. Forman
*Attorney, Agent, or Firm*—MacMillan, Sobanski & Todd

[57] ABSTRACT

An inproved rotary paint atomizing device of the type having an internal chamber for receiving paint from a paint feed tube extending coaxially through a drive shaft which rotates the device at a high speed. An annular insert is clamped between the drive shaft and the device for forming a rear wall of the paint receiving chamber. The insert prevents paint from splashing into the annular space between the rotating drive shaft and the stationary paint feed tube. When the device is removed from the shaft. The separate insert permits easy access to the paint receiving chamber for cleaning.

7 Claims, 1 Drawing Sheet

ROTARY ATOMIZING DEVICE

TECHNICAL FIELD

The invention relates to electrostatic spray painting and more particularly to electrostatic coating apparatus which includes an improved high speed rotary paint atomizing device for atomizing paint through centrifugal force.

BACKGROUND ART

Electrostatic rotary paint atomizers are often used for painting workpieces in industrial applications. The paint is atomized by flowing over the inside of an enlarging diameter conical or bell shaped surface as the surface is rotated at a very high speed. When the paint reaches an outer annular edge of the surface, it is thrown from the edge and atomized through the action of centrifugal force. At the same time the paint is atomized, it is subjected to a very high voltage relative to the workpiece which imparts an electrostatic charge on the atomized paint. The electrostatic charge attracts the atomized paint to the workpiece to provide a high coating transfer efficiency. Sometimes the atomized paint also is subjected to a flow of air surrounding the atomizing device to further aid in directing the atomized paint to the workpiece. Electrostatic rotary atomizers are known for their high transfer efficiency, high paint throughput and for the application of a high quality coating.

The design of the rotary atomizing device is both a science and an art. Very small changes in the design can have a profound effect on the quality of the applied coating. For coating large surface areas such as automobile bodies and where larger paint throughputs are required, the device may have a diameter of about 3 inches (about 7.5 cm) at the paint discharge edge. For smaller surfaces and where lower paint throughputs are required, a smaller device having an annular paint discharge edge with a diameter of about 1 inch (about 2.5 cm) may be used. The device is mounted on a shaft of a motor, such as an air driven turbine, for being rotated at high speeds which may range, for example, from 10,000 rpm to 40,000 rpm or more. Paint is delivered from a source through a feed tube to an internal chamber in the device. For some devices, the paint is delivered by a feed tube located to one side of the turbine shaft. For other devices, the turbine shaft is hollow and the paint is delivered through a stationary feed tube extending coaxially through the turbine shaft. Paint fed to the internal chamber attaches itself either to an outer annular surface of the chamber or to a front wall surface of the chamber. The paint is accelerated to the speed of the adjacent surface and tends to move outwardly through centrifugal force. Preferably, the surfaces are sloped to direct the paint flow towards a series of uniformly spaced openings through the front surface of the chamber. The paint flows through the openings and attaches itself to the conical or bell shaped surface which leads to the annular paint discharge edge at the front of the device.

When paint is fed to the internal chamber in the atomizing device along the axis of the device, the chamber is preferably closed at its rear by a radially inwardly directed rib which is spaced close to the stationary paint feed tube. The rib is necessary to prevent paint from splashing back or flowing into the annular opening between the rotating drive shaft and the stationary paint feed tube. If paint should collect in this annular space, it generally would not be removed by automatic cleaning cycles in which paint supplied to the device is replaced by solvent. The paint would eventually harden and could interfere with operation of the atomizer. Manual cleaning of the device is time consuming since it requires removal of the atomizing device from the turbine shaft. It is sometimes necessary to remove the device from the turbine shaft for cleaning the internal chamber and the small passages connecting the chamber with the front of the device to remove obstructions. However, the rib which forms the rear surface of the paint receiving chamber makes it difficult to manually clean the chamber and the passages. Cleaning the internal chamber is especially difficult for smaller diameter atomizing devices where the opening into the chamber is quite small. The rib also makes the atomizing device expensive to manufacture. In the past, it has been necessary to manufacture the device by machining from a solid block of a material such as aluminum. The internal rib which formed the rear wall of the paint receiving chamber prevented effectively molding or casting the device, which could significantly reduce the manufacturing cost of the device.

DISCLOSURE OF INVENTION

According to the invention, the paint receiving chamber of an otherwise conventional rotary atomizing device is modified to facilitate both manufacturing and cleaning the device. The device is manufactured with an internal paint receiving chamber having a front wall of the same design as in prior art devices. However, the radially inwardly directed rib normally found at the rear of the chamber is eliminated, leaving the rear of the chamber open. The open rear facilitates manufacture of the device since it permits the device to be molded or cast from, for example, a synthetic resinous material, or to be more easily machined. During use, removal of the device from the turbine shaft leaves a larger diameter opening than with similar prior art devices for inserting a brush to clean the paint receiving chamber and the small passages through the front wall of the chamber. The rear wall of the chamber is formed by a separate annular insert which has at its rear a step for engaging the end of the turbine shaft. At its front, the insert has a conical outer edge which abuts an internal step in the device to align the insert coaxially with the device and to form a seal between the insert and the device. At its front, the insert has a conical surface which in combination with centrifugal force causes any paint which contacts the front surface to flow outwardly and forwardly towards the passages through the front wall of the chamber.

When the atomizing device requires cleaning after use, it is unscrewed from the turbine shaft. The insert will remain on the end of the drive shaft and the paint contacting surfaces may be cleaned with the brush. Or the insert may be separated from the turbine shaft for a more thorough cleaning.. The insert, the inside of the device and the end of the paint feed tube are fully exposed to facilitate cleaning.

Accordingly, it is an object of the invention to provide an improved rotary atomizing device having an internal paint receiving chamber which can be exposed for cleaning.

Other objects and advantages of the invention will become apparent from the following detailed description, with reference being made to the accompanying drawings.

BEST MODE FOR CARRYING OUT THE INVENTION

Figure 1:
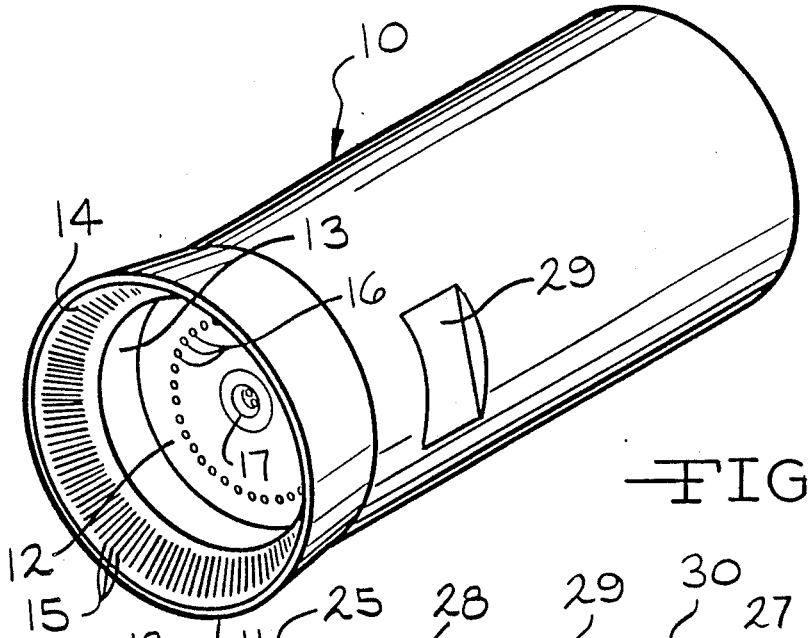
FIG. 1 is a perspective view of a rotary atomizing device according to the invention.

Turning to the drawings and particularly to FIG. 1, a rotary atomizing device 10 is shown according to the invention. The body of the illustrated device 10 has a relative small diameter at a front, outermost paint discharge edge 11, such as a diameter of about 1 inch or about 2.5 cm. However, it should be understood that the invention is equally applicable to other diameter rotary atomizing devices and to rotary atomizing devices having other known shapes.

The device 10 has a generally flat circular front wall 12 connecting at its perimeter with a first conical surface 13 which slopes forwardly and slightly outwardly. The conical surface 13 connects with a second conical surface 14 which leads to the outer paint discharge edge 11. The surface 14 has a greater slope than the surface 13 to increase the rate at which paint flows over the surface 14 to the edge 11 and to simultaneously decrease the thickness of the paint film as it flows over the surface 14. Preferably, the surface 14 includes a series of radial grooves or serrations 15 which improve the uniformity of the paint film flowing over the surface 14 and hence improve the uniformity and fineness of the atomized paint particles, as is known in the prior art. If the device is molded, for example, from a synthetic resinous material, the serrations 15 are readily molded into the surface 14. Otherwise, the serrations may be milled into the surface 14. It is not necessary for the serrations 15 to extend completely between the surface 13 and the edge 11 to be effective in improving atomization.

A plurality of closely spaced small diameter passages 16 extend through the front wall 12. The passages are uniformly spaced from the rotational axis of the device 10. The paint to be atomized flows from the passages 16 onto the front surface 12 and through centrifugal force accelerates in a radial direction, flowing outwardly onto the surface 13. As the paint film continues to flow outwardly, it also flows forwardly over the conical surface 13 and than over the conical surface 14 to the edge 11. The paint is thrown from edge 11 in small streams or ribbons which break up into finely atomized paint droplets. At the same time, an electrostatic charge is imparted to the atomized paint either directly by making the device 10 from an electrically conductive material and applying a high voltage to the device 10 relative to the workpiece (not shown) or indirectly by establishing and passing the atomized paint particles through a strong electric field in the vicinity of the edge 11.

As is known in the prior art, a small flow of paint also may emanate from a center region 17 of the wall 12 and flow over such center region of the wall 12 to facilitate cleaning the wall 12. Without such a flow of paint, some atomized paint droplets may tend to accumulate on the wall 12 and harden. The hardened paint must be manually cleaned from the exterior surfaces of the wall 12. A small flow of paint over the exterior surfaces of the wall 12 prevents any accumulated paint from hardening and also permits solvent to automatically flow over the wall 12 when the paint flow is replaced with solvent. Thus, the exterior surfaces of the wall 12 will be automatically cleaned along with the device 10.

Figure 2:
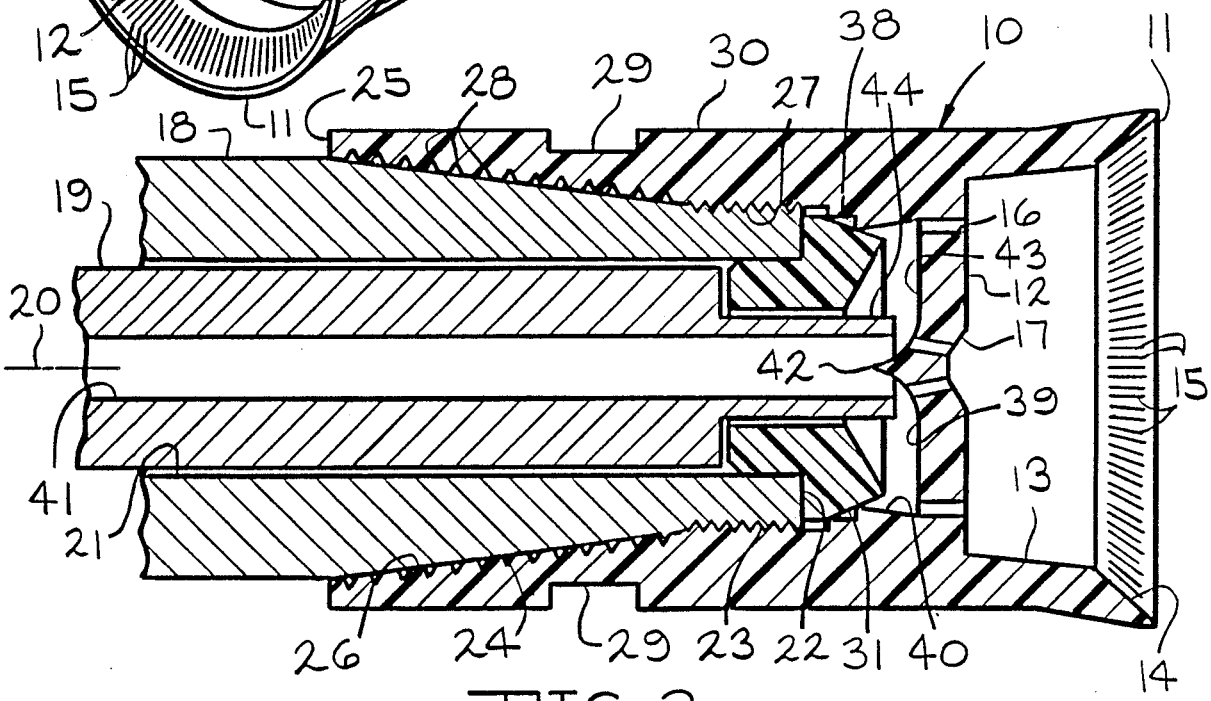
FIG. 2 is an enlarged cross sectional view through a rotary atomizing device according to the invention with a fragmentary portion of an attached drive shaft and a paint feed tube.

Turning to FIG. 2, a detailed cross sectional view is shown through the rotary atomizing device 10 and fragmentary portions of an attached drive shaft 18 and a stationary paint feed tube 19. The drive shaft 18 is rotated at high speeds about an axis 20 by a suitable motor (not shown), such as an air driven turbine. The drive shaft 18 is tubular, having an interior opening 21. The drive shaft 18 has a reduced diameter end 22 having an exterior threaded portion 23. A conical surface 24 extends symmetrically about the axis 20 between the threaded portion 23 and the normal diameter of the drive shaft 18 to facilitate alignment of the rotary atomizing device 10 coaxially on the drive shaft 18.

At a rear end 25, the atomizing device 10 has an opening defined by a conical surface 26 and an internally threaded portion 27 which are complimentary to, respectively, the conical surface 24 and the threaded portion 23 on the drive shaft 18. A series of annular grooves 28 may be formed in the conical surface 26 to facilitate alignment of the device 10 on the shaft 18 and removal of the device 10 from the shaft 18. Any dirt or small particles on the shaft surface 24 will move into the grooves 28 as the device 10 is screwed onto the shaft 18. As a consequence, such dirt or particles will not interfere with the precise alignment of the device 10 on the shaft 18. Precise alignment is critical to obtain a dynamic balance because of the extremely high speeds that the shaft 18 and the attached device 10 are rotated. The grooves 28 also reduce the surface contact area between the device 10 and the shaft 18, making it easier to remove the device 10 from the shaft 18. To further aid in attaching the device 10 to and removing the device 10 from the shaft 18, flats 29 are formed in an exterior surface 30 of the device 10 for receiving a suitable wrench (not shown).

Figure 3:
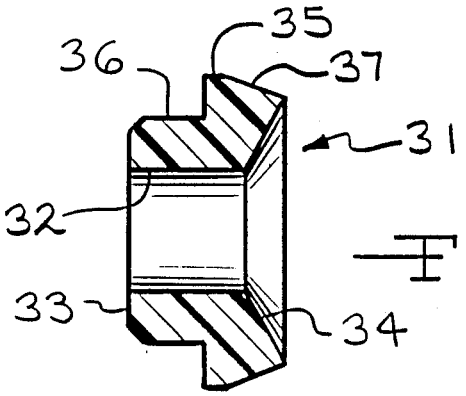
FIG. 3 is an enlarged cross sectional view of the removable annular insert for forming one side of a paint receiving chamber inside the rotary atomizing device.

The device 10 includes a separate annular insert 31 which is positioned on the end of the drive shaft 18. Details of the insert 31 are shown in FIGS. 2 and 3. The insert 31 has an axial opening 32 extending between a rear edge 33 and a conical front surface 34. The insert 31 has an exterior surface portion 35 having a diameter no greater than the diameter of the threaded portion 23 at the drive shaft end 22. To the rear of the portion 35, the insert 31 has a reduced diameter end 36 equal in its exterior diameter to the interior diameter of the shaft opening 21. The end is shaped to slide into and closely engage the walls of the shaft opening 21 with the exterior surface portion 35 of the insert 31 abutting the shaft end 22. The conical front surface 34 on the insert 31 opens to the front. An inwardly converging conical surface 37 extends from the portion 35 to the front surface 34.

In removably attaching the device 10 to the shaft 18, the insert 31 is initially positioned on the end 22 of the shaft 18. The device 10 is then positioned coaxially over the shaft end 22 and the device threads 27 are threaded onto the shaft threads 23. The conical shaft and device surfaces 24 and 26 precisely align the device 10 coaxial with the shaft axis 20. When the device 10 is completely threaded onto the shaft 18, the conical surface 37 on the insert 31 contacts and seals against a radially inwardly directed step 38 in the interior opening in the device 10.

When the device 10 is attached to the shaft 18, a paint receiving chamber 39 is formed between the front wall 12, the insert surface 34 and a side wall surface 40 in the device 10. Preferably, the surface 40 is slightly conical, opening in a forward direction to the paint passages 16. The stationary paint feed tube 19 extends coaxially through the drive shaft opening 21. Sufficiently clearance is provided between the tube 19 and the walls of the drive shaft opening 21 to prevent contact as the drive shaft 18 is rotated. The paint feed tube 19 has an axial opening 41 which discharges paint into the chamber 39 and preferably onto a conical projection 42 at the center of an interior surface 43 on the front wall 12. Preferably, the paint feed tube 19 has a reduced exterior diameter end 44 which is of a size to pass through the axial opening 32 through the insert 31. A small clearance is provided between the paint feed tube 19 and the insert opening 32 to prevent contact as the insert is rotated with the device 10 and the drive shaft 18.

Once attached to the drive shaft 18, the rotary atomizing device 10 will function in a manner similar to prior art rotary atomizing devices which have an integral interior rib forming the rear wall of the paint receiving chamber. However, when the device 10 is unscrewed from the drive shaft 18, the insert 31 will remain on the drive shaft 18. A suitable cleaning brush (not shown) is easily inserted into the interior of the device 10 for cleaning the surfaces of the paint receiving chamber 39 and the paint passages 16, even though the device 10 may be of a small diameter. The surfaces 34 and 37 on the insert 31 also are easily cleaned while the insert 31 remains on the shaft 18. In prior art devices of this type, the cleaning brush had to pass through a fixed opening of a size corresponding to the interior opening 32 through the insert 31 and could not effectively clean the paint receiving chamber. Also, it was sometimes difficult to see and remove obstructions to the passages 16 in the prior art devices.

It will also be noted that the device 10 may be molded from a synthetic resinous material. Only minimum machining is required to finish the interior of the device 10, namely, for forming the grooves 28, for cutting the threads 27 and for providing any slope to the side wall 40. It is not necessary to machine a large undercut region to form the paint receiving chamber 39.

Although a specific preferred embodiment of the device 10 has been illustrated and described, it should be understood that the invention is equally applicable to other known types of rotary atomizing devices. For example, in some rotary atomizing devices, the wall 12 may be formed from a separate part which is screwed or otherwise attached to the body of the device. The surfaces 13 and 14 may be a single surface or may be several surfaces with steps therebetween or may have a curved bell like shape rather than a conical shape. Further, the paint discharge edge 11 may be sharp or rounded and may be of an appreciably larger diameter than in the exemplary device 10. It will be appreciated that various other modifications and changes may be made in the rotary atomizing device without departing from the spirit and the scope of the following claims.

I claim:

1. A rotary paint atomizing device for attachment to a free end of a rotatable tubular drive shaft having an axial passage with a paint feed tube extending coaxially therethrough, said device having an axis of rotation with first and second ends on said axis, said first end of said device forming an opening for receiving said drive shaft end, means in said opening for removably attaching said device to said drive shaft end to retain said device coaxially on said drive shaft end, a surface at said second end for receiving paint and delivering a flowing film of such paint to a paint discharge edge, a front wall separating said first and second ends, said wall having an interior surface forming a forward wall portion of a paint receiving chamber, a plurality of passages through said wall for distributing paint from said chamber onto said surface as said device is rotated by said drive shaft, said device being characterized by an annular insert positioned coaxially with said shaft and said device and clamped between said drive shaft end and said device, said insert having an axial opening, said insert forming a removable rear wall portion of said paint receiving chamber for providing access to said chamber, and wherein said paint feed tube extends coaxially into said insert opening.

2. A rotary paint atomizing device, as set forth in claim 1, wherein said paint feed tube extends coaxially through said insert opening.

3. A rotary paint atomizing device, as set forth in claim 2, wherein said insert opening and said paint feed tube have a minimum clearance therebetween to permit said device to rotate about said paint feed tube without contact between said insert and said paint feed tube.

4. A rotary paint atomizing device as set forth in claim 3, wherein said insert has a conical front surface symmetrical about said axis, said conical front surface opening forwardly and outwardly towards said interior surface of said front wall to direct paint contacting said front insert surface towards said front wall passages through centrifugal force as said device is rotated.

5. A rotary paint atomizing device, as set forth in claim 4, wherein said insert has a central exterior portion of a diameter greater than the diameter of said drive shaft passage and no greater than the outside diameter of said drive shaft end and a reduced diameter rear end of a diameter for passing into and closely engaging the walls of said drive shaft passage at said free end, whereby said insert may be positioned on said drive shaft end when attaching said device to said drive shaft end and whereby said insert is tightly clamped between said drive shaft end and said device when said device is attached to said drive shaft.

6. A rotary paint atomizing device, as set forth in claim 1, wherein said insert has a conical front surface symmetrical about said axis, said conical front surface opening forwardly and outwardly towards said interior surface of said front wall to direct paint contacting said front insert surface towards said front wall passages through centrifugal force as said device is rotated.

7. A rotary paint atomizing device, as set forth in claim 6, wherein said insert has a central exterior portion of a diameter greater than the diameter of said drive shaft passage and no greater than the outside diameter of said drive shaft end and a reduced diameter rear end of a diameter for passing into and closely engaging the walls of said drive shaft passage at said free end, whereby said insert may be positioned on said drive shaft end when attaching said device to said drive shaft end and whereby said insert is tightly clamped between said drive shaft end and said device when said device is attached to said drive shaft.

* * * * *